US007494074B2

(12) United States Patent
Benstead

(10) Patent No.: US 7,494,074 B2
(45) Date of Patent: Feb. 24, 2009

(54) FAUCET SPRAYHEAD WITH MODE AND VOLUME CONTROLS

(75) Inventor: Evan Benstead, Los Angeles, CA (US)

(73) Assignee: Newfrey LLC, Newark, DE (US)

( * ) Notice: Subject to any disclaimer, the term of this patent is extended or adjusted under 35 U.S.C. 154(b) by 87 days.

(21) Appl. No.: 11/414,932

(22) Filed: May 1, 2006

(65) Prior Publication Data

US 2007/0252022 A1 Nov. 1, 2007

(51) Int. Cl.
*B05B 17/04* (2006.01)
*E03C 1/084* (2006.01)
*E03C 1/04* (2006.01)

(52) U.S. Cl. ..... 239/449; 239/11; 239/396; 239/428.5; 239/447; 4/678

(58) Field of Classification Search ..... 239/449, 239/11, 396, 428.5, 447, 390, 436, 442–446, 239/448, 525, 527, 581.2, 582.1; 137/625.5, 137/625.48, 801; 4/678
See application file for complete search history.

(56) References Cited

U.S. PATENT DOCUMENTS 3,722,799 A 3/1973 Rauh
3,762,648 A 10/1973 Deines et al.
3,967,783 A 7/1976 Halsted et al.
4,079,891 A 3/1978 Kwan
4,190,207 A 2/1980 Fienhold et al.
4,733,818 A 3/1988 Aghnides
4,733,819 A 3/1988 Aghnides
5,316,216 A 5/1994 Cammack et al.
5,398,872 A 3/1995 Joubran
5,427,318 A 6/1995 Lee
6,085,790 A * 7/2000 Humpert et al. ..... 137/801
6,325,930 B2 12/2001 Farley
6,360,967 B1 3/2002 Schorn
6,367,710 B2 4/2002 Fan
6,557,785 B1 5/2003 Knapp
6,631,859 B2 10/2003 Schmidt
6,715,699 B1 4/2004 Greenberg et al.
6,742,725 B1 6/2004 Fan (Continued)

FOREIGN PATENT DOCUMENTS

CA 2437357 8/2005

(Continued)

*Primary Examiner*—Darren W Gorman
(74) *Attorney, Agent, or Firm*—Ober / Kaler; Royal W. Craig

(57) ABSTRACT

A sprayhead especially suited for coupling to an extension hose for use in a pull-out kitchen faucet, the sprayhead including a selector subassembly for choosing between both spray and aerate modes, and a volume control built in to the sprayhead. The selector subassembly is engaged to a detent finger-button mounted on the housing that selectively diverts water flowing through an aerated flow path to an alternate spray flow path, thereby allowing manual selection between spray mode and aerate mode. The volume control is a slide switch on the housing and coupled to a rotary valve assembly for allowing the user to adjust the flow volume when in spray mode without affecting water volume in the aerate mode. When in aerate mode water is expelled from the sprayhead through an aerator output, and when in spray mode water is expelled through a series of nozzles oriented radially around the aerator output.

17 Claims, 9 Drawing Sheets

U.S. PATENT DOCUMENTS

| | | | | |
|---|---|---|---|---|
| 6,938,837 | B2 | 9/2005 | Nelson et al. | |
| 6,951,286 | B2 | 10/2005 | Mueller et al. | |
| 6,962,298 | B1 | 11/2005 | Martin | |
| 2001/0023901 | A1* | 9/2001 | Haverstraw et al. | 239/443 |
| 2004/0124281 | A1 | 7/2004 | Leung | |
| 2004/0217209 | A1 | 11/2004 | Bui | |
| 2004/0227014 | A1* | 11/2004 | Williams et al. | 239/443 |
| 2004/0250851 | A1 | 12/2004 | Clark | |
| 2004/0255377 | A1 | 12/2004 | Mueller et al. | |
| 2005/0098661 | A1 | 5/2005 | Lev | |
| 2005/0125890 | A1 | 6/2005 | Zhadanov | |
| 2005/0205697 | A1 | 9/2005 | Lo | |
| 2005/0279864 | A1 | 12/2005 | Fan | |
| 2005/0284967 | A1 | 12/2005 | Korb et al. | |
| 2006/0043214 | A1 | 3/2006 | Macan et al. | |

FOREIGN PATENT DOCUMENTS

| | | |
|---|---|---|
| EP | 962256 | 12/1999 |
| EP | 1577016 | 9/2005 |
| GB | 2388332 | 11/2003 |

* cited by examiner

FAUCET SPRAYHEAD WITH MODE AND VOLUME CONTROLS

BACKGROUND OF THE INVENTION

1. Field of the Invention

The present invention relates to faucet sprayheads, and more particularly to a sprayhead for a kitchen faucet with both spray and aerate modes, the sprayhead including a volume control for reducing/increasing the volume of water when the sprayhead is in spray mode, but with no affect on the volume of water when in aerate mode.

2. Description of the Background

Faucets, especially kitchen faucets, are commercially available in numerous designs and configurations. Many are equipped with spray heads which are intended to improve or change the water spray pattern. Some modern faucets include a pull-out spray head. Some of these include a selector to dispense either an aerated stream or spray pattern. For example, U.S. Pat. No. 6,938,837 to Nelson et al. issued Sep. 6, 2005 shows a faucet spray head assembly with a diverter valve to control water flow patterns.

A volume control would be helpful with a spray pattern, but is unnecessary with the aerated stream. No known pull-out kitchen faucet spray heads include both the selector for an easy switch from aerate mode to spray mode, plus a volume control for the spray mode that does not affect the aerate mode flow. Therefore, there is a need for an improved sprayhead that delivers water in a desirable and uniform manner, in selectable spray and aerate modes, with a volume control for reducing/increasing the volume of water when the sprayhead is in spray mode, but with no affect on the volume of water when in aerate mode.

SUMMARY OF THE INVENTION

It is, therefore, the primary object of the present invention to provide an improved sprayhead particularly suited for a pull-out kitchen faucet that delivers water in selectable spray and aerate modes.

It is another object to provide a sprayhead as described above having a volume control for reducing/increasing the volume of water when the sprayhead is in spray mode, but with no affect on the volume of water when in aerate mode.

It is another object to provide a sprayhead as described above that is economical to manufacture and produce, yet which delivers water in a desirable and uniform manner.

It is another object to provide a sprayhead with both spray and aerate mode selector, and spray volume controls, in an aesthetically pleasing configuration.

It is still another object to provide a sprayhead configuration capable of in selectable spray and aerate modes via a selector subassembly that can be implemented in many varied aesthetic styles of faucet simply by changing an outer housing and selector button.

The present invention is a sprayhead for a kitchen faucet with a selector subassembly to allow a choice between both spray and aerate modes, and that includes a volume control built in to the sprayhead.

The sprayhead generally includes an aesthetically-pleasing outer housing with an assemblage of internal conduits defining a water input path, a spray flow path leading to a spray outlet, and an aerated flow path leading to an aerated outlet. The sprayhead includes a detent finger-button mounted on the housing and engaged to a diverter subassembly for selectively interrupting the aerated flow path to thereby divert water into the spray flow path, thereby allowing manual selection between spray mode and aerate mode. The sprayhead also includes a slide switch coupled to a rotary valve assembly for allowing the user to adjust the flow volume of the sprayhead when in spray mode without affecting water volume in the aerate mode. When in aerate mode water is expelled from the sprayhead through an aerator output, and when in spray mode water is expelled through a series of nozzles oriented radially around the aerator output. The sprayhead disclosed herein is especially suited for attachment to an extension hose for use in a pull-out kitchen faucet. When the sprayhead is in spray mode, and volume control actuator is turned, the volume of water coming from the sprayer is reduced or increased. However, when the sprayhead is in aerate mode, the volume control has no effect on the volume of water coming from the aerator. The volume control may be set by a user to a desired volume and left alone thereafter, such that any actuation back into spray mode will result in the desired water volume coming from the sprayer. Alternately, the setting for the volume control may be changed while in spray mode, to vary the volume of water coming from the sprayer on demand.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

The present invention is a sprayhead for a kitchen faucet with both spray and aerate modes, the sprayhead including a volume control for reducing/increasing the volume of water when the sprayhead is in spray mode, but with no affect on the volume of water when in aerate mode.

Figure 1:
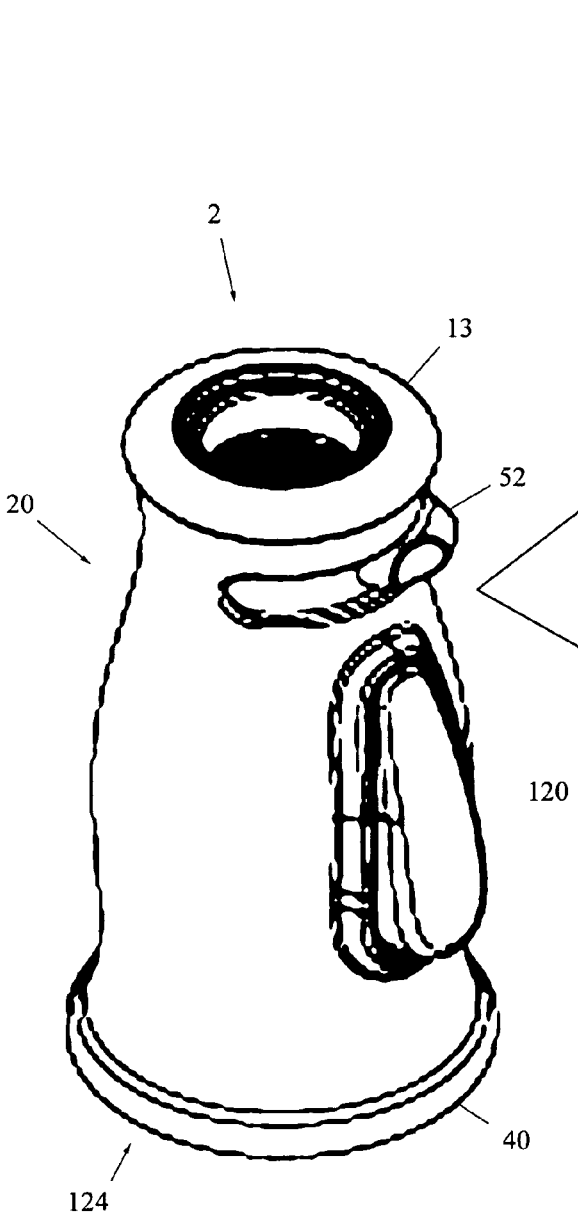
FIG. 1 is a perspective view of a sprayhead 2 according to an exemplary embodiment of the present invention adapted for screw-connection to a pull-out faucet hose.

FIG. 1 is a perspective view of a sprayhead 2 according to an exemplary embodiment of the present invention adapted for screw-connection to a pull-out faucet hose. The sprayhead 2 generally comprises a stylized outer housing 20 with integral detent finger-button 120 to allow the user to select between spray mode and aerate mode, and an integral slide switch 52 for reducing/increasing the volume of water when the sprayhead is in spray mode, but with no affect on the volume of water when in aerate mode. The detent finger-button 120 remains in a normally unbiased position for aerate mode, and is depressed for spray mode, the slide switch 52 remaining in position for preset of the volume of water in spray mode.

Figure 2:
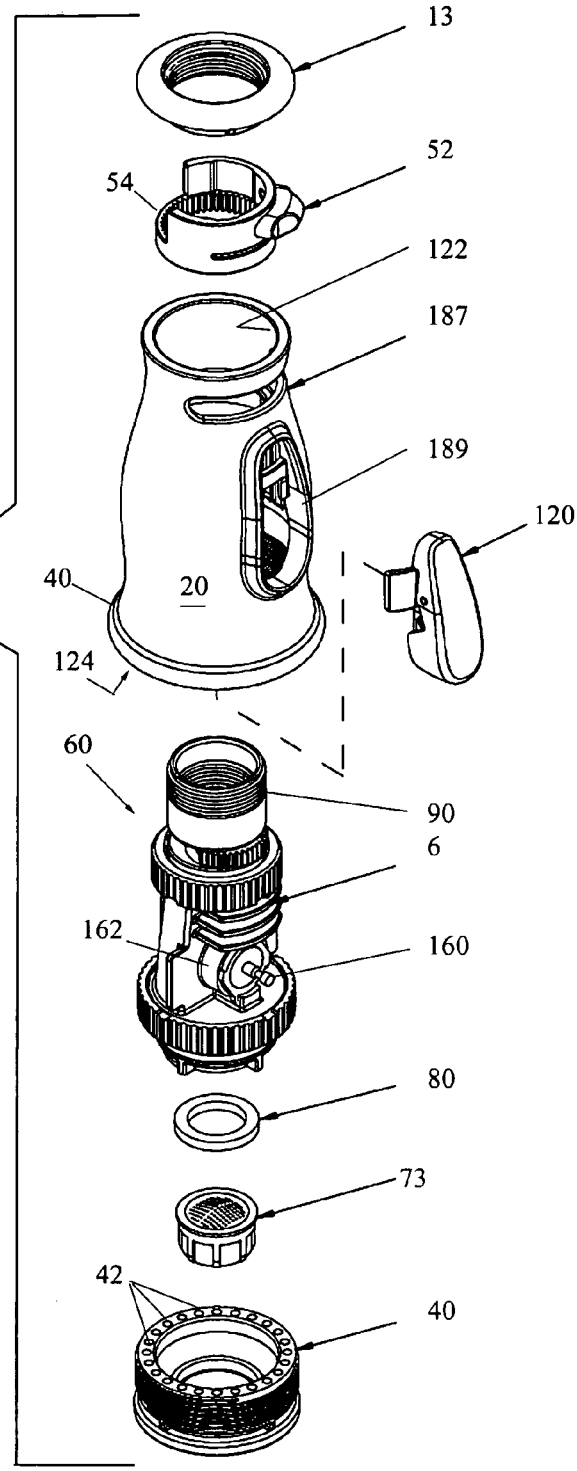
FIG. 2 is an exploded drawing of the major components of the sprayhead 2.
Figure 3:
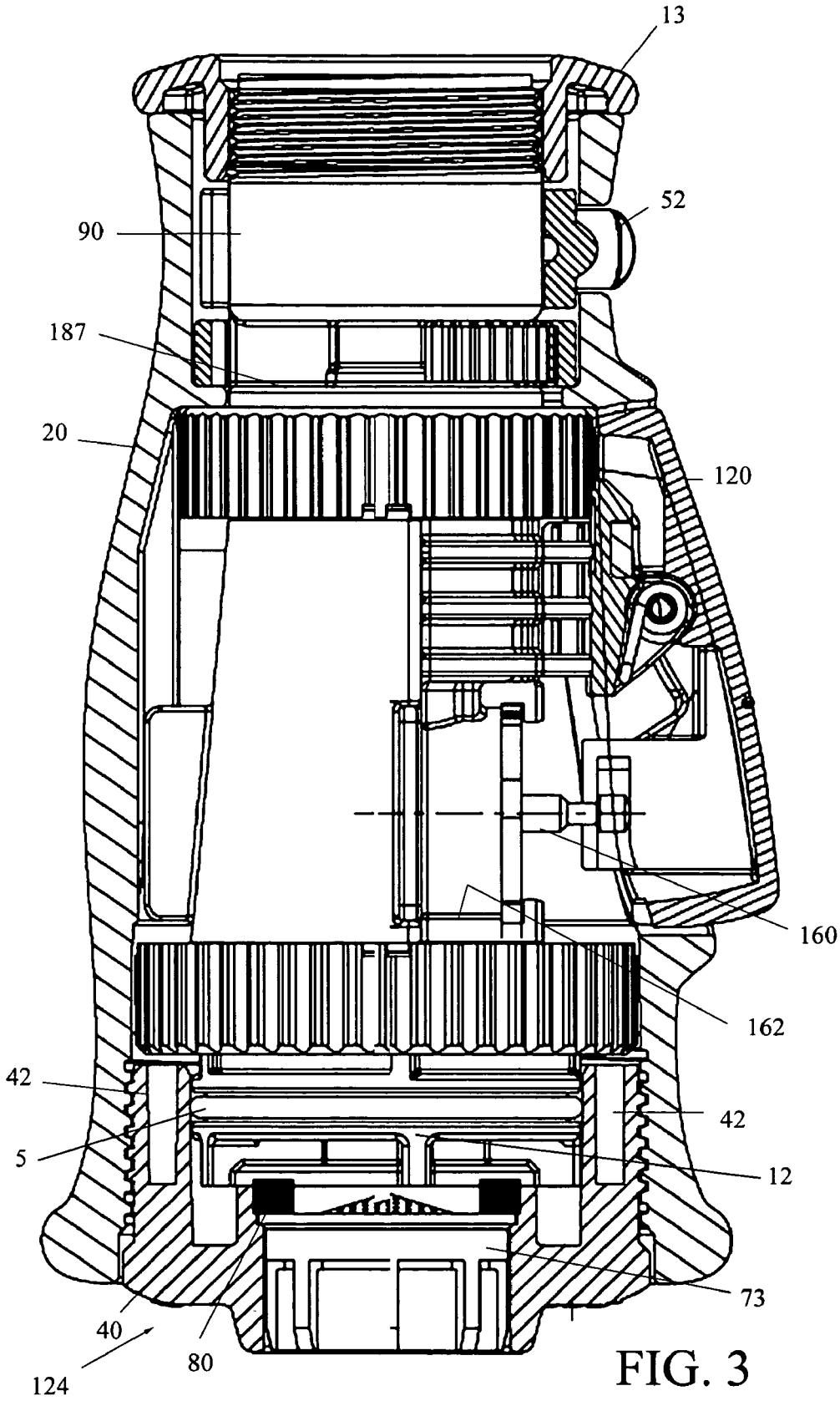
FIG. 3 is a side cross-section of the major components of the sprayhead 2.

FIG. 2 is an exploded drawing of the major components of the sprayhead 2, and FIG. 3 is a side cross-section. With combined reference to FIGS. 2 and 3, the outer housing 20 is a generally tubular downwardly-flared component with upper aperture 122, lower aperture 124, a radial slot 187 formed proximate the upper aperture 122 for passing the slide switch 52 and an axial slot 189 for detent-seating of the finger-button 120. The slide switch 52 is integrally formed on an annular collar 54 formed with inwardly disposed gear teeth, and the collar 54 is rotatably seated inside the housing 20 with slide switch 52 protruding outward through slot 187 for finger access. Collar 54 is a compressible component self-captured into housing 20 by squeezing collar 54, thereby radially compressing it, and inserting into housing upper aperture 120. Thus, once in position, collar 54 will radially expand itself, and slide switch 52 will extend / protrude from radial slot 187, and the collar 54 becomes captured within housing 20. Flanged retaining cap 13 is used to hold a selector subassembly 60 in housing 20. Cap 13 has an internal thread that attaches to an external thread on upper conduit 90. The external extension hose (not shown) is inserted to the internal thread of upper conduit 90. The selector sub-assembly 60 (to be described) is enclosed within the housing 20 and this provides the internal mechanism for selection between spray and aerate modes, and volume adjustment of the spray. The selector sub-assembly 60 provides a dual-output through the lower aperture 124 of housing 20, either through a centrally-positioned aerator 70 (sealed against the selector sub-assembly 60 by a Face Seal 80), or a spray outlet 40 that encircles the aerator 73.

Figure 4:
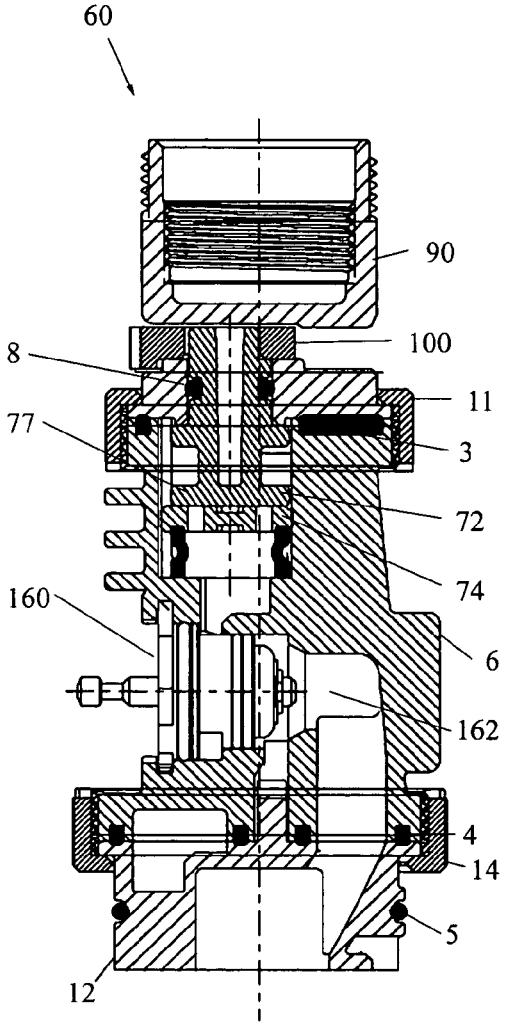
FIG. 4 is a side cross-section of the major components of the selector sub-assembly 60.
Figure 5:
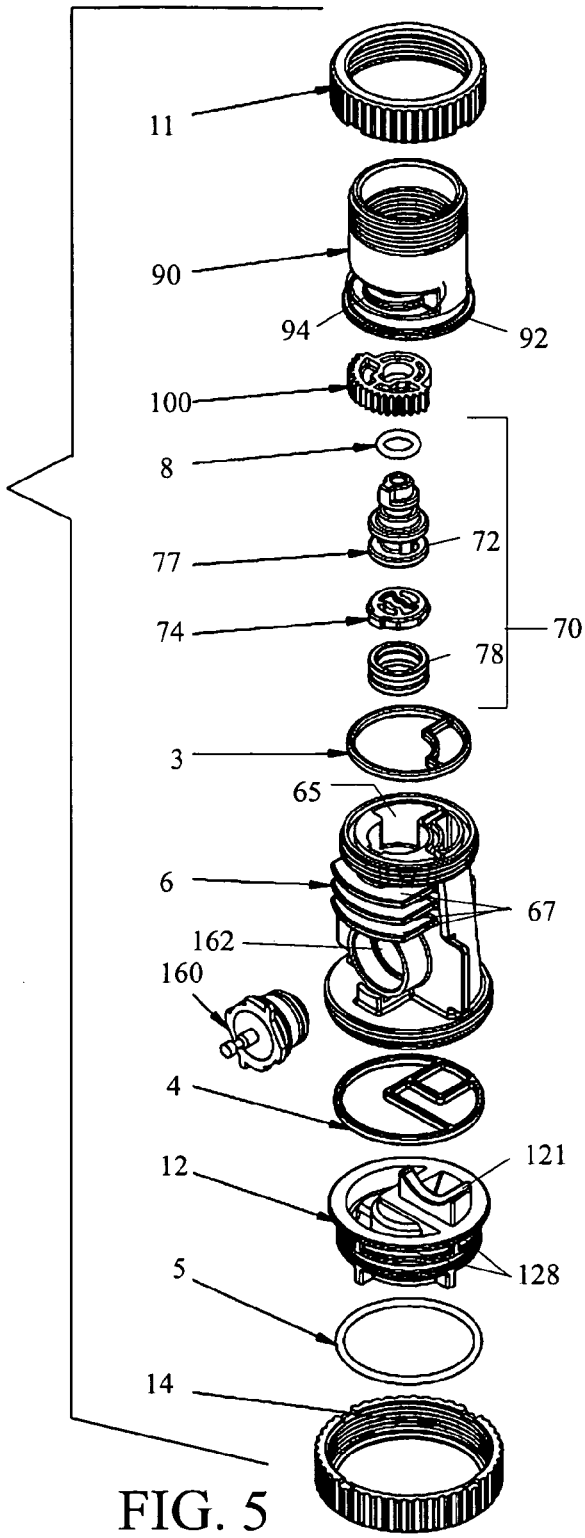
FIG. 5 is an exploded drawing of the major components of the selector sub-assembly 60.

FIG. 4 is a side cross-section of the major components of the selector sub-assembly 60, and FIG. 5 is an exploded drawing. Water enters the selector sub-assembly 60 through an upper conduit 90, which is in fluid communication with a central conduit 6, which is in turn in fluid communication with a lower conduit 12. Seals 3 and 4 are interposed between the upper and central conduits 90, 6, and central and lower conduits 6, 12, respectively, to ensure a tight fluid coupling. Seal 5 seals the lower conduit 12 against the spray outlet 40 as shown in FIG. 3.

Figure 8:
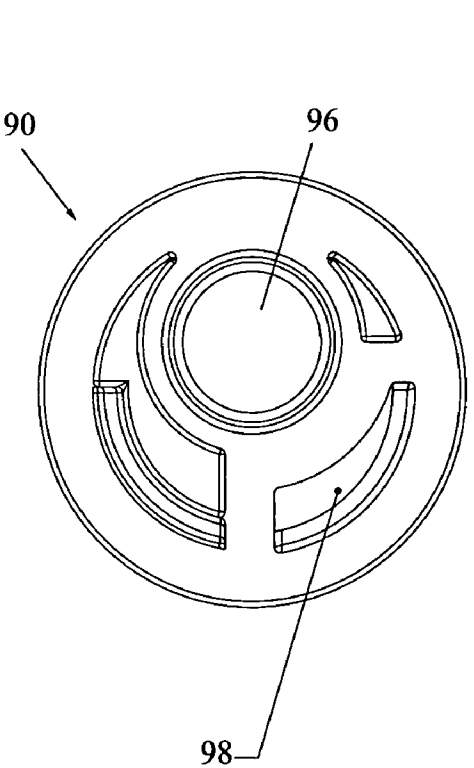
FIG. 8 is a bottom view of the upper conduit 90.
Figure 7:
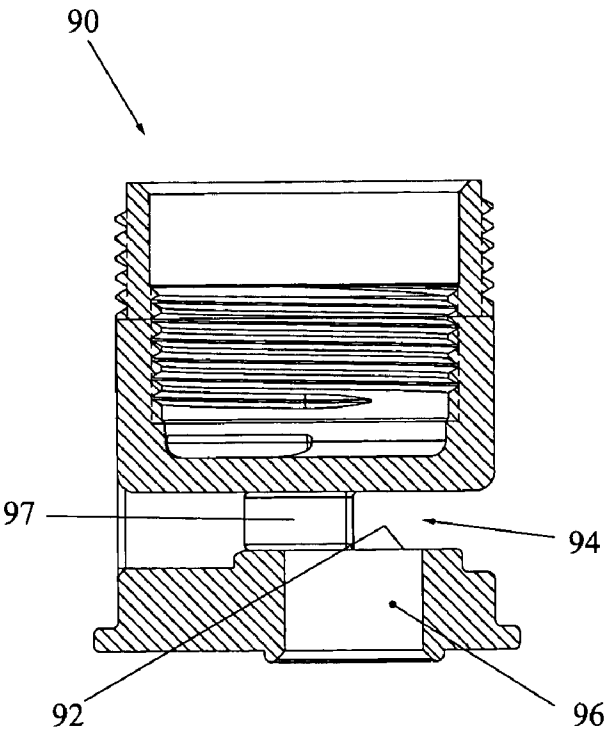
FIG. 7 is a side cross-section of the upper conduit 90.
Figure 6:
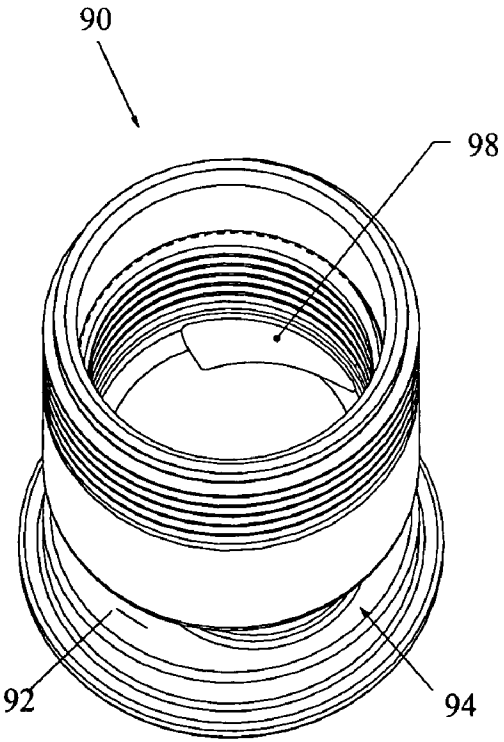
FIG. 6 is a perspective illustration of the upper conduit 90.

FIG. 6 is a perspective illustration of the upper conduit 90, FIG. 7 is a side cross-section, and FIG. 8 is a bottom view. The upper conduit 90 is a tubular member with upper internally-threaded barrel for attachment to the extension hose of the pull-out faucet. The upper barrel leads inward into a port 98 which leads outward through a lower platform 92 and through the bottom (FIG. 8). A post 97 connects the upper barrel to lower platform 92, and platform 92 is spaced from the upper barrel and is substantially open around a majority of the circumference by the open slot 94 which partially encircles the platform 92. A circular aperture 96 enters the platform 92 from beneath to provide a nest for a volume control stem 77 (to be described). Water flowing into the upper barrel of upper conduit 90 flows inward into port 98 through the bottom of platform 92, and continues into central conduit 6.

Referring back to FIG. 5, a ring gear 100 is pivotally seated on the platform 92 inside upper conduit 90, and the ring gear 100 exposes peripheral teeth outward through slot 94. The outwardly-disposed teeth of ring gear 100 engage the inwardly disposed gear teeth of collar 54 (FIG. 1), and hence the slide switch 52 protruding outward through slot 126 of housing 20 actuates the ring gear 100. The ring gear 100 in turn is distally mounted on a volume control stem 77 that is inserted into the bottom of the circular aperture 96. An o-ring 80 rides on the volume control stem 77 seals the stem 77 against the upper conduit 90. Volume control stem 77 controls two rotary flow control discs 72, 74, which engage in the manner of a conventional ¼ turn valve to adjust flow volume. One of the rotary flow control discs 72 is mounted integrally at the bottom of the valve control stem 77, and the other 74 rides there beneath, the two flow control discs 72, 74 being biased against each other by a compression seal 78. The compression seal 78 is similar to a standard rubber face seal, but additionally includes a "bellow" in the center section, which gives it a spring like bias and makes it more easily compressible. In this way, it is ensured that when the subassembly 60 is tightened (by collar 11 to be described), the compression seal 78 will easily deform. This also allows seal 3 to be compressed consistently, since both seal 3 and compression seal 78 are handled simultaneously by collar 11. In addition, water pressure from beneath disc 74 helps to bias discs 72, 74 against each other. The discs 72, 74 are seated in an upper chamber 65 within the central conduit 6.

The central conduit 6 itself is a complex tubular member (to be described) having triple flow paths there through, one for water input from upper conduit 90, one for a spray flow path and one for an aerated flow path, and a diverter chamber 162 entering sidelong into the aerated flow path, and having a diverter piston assembly 160 loaded therein for selectively interrupting the aerated flow path for diverting fluid flow to the spray flow path. The diverter piston assembly 160 is detailed below and is controlled (urged in and out of the central conduit 6) by operation of the detent finger-button 120 on the outer housing 20. The central conduit 6 is in fluid communication with a bottom conduit 12, sealed there against by a bottom seal 4. The bottom conduit 12 employs a curved facing surface 121 opposed to the input flow path of the central conduit 6 to re-direct water back upwards, into the diverter chamber 162 as will be described, and ultimately outward through the aerator 7 (FIG. 2). If, on the other hand, spray output is selected, the selected volume of water exits the volume control assembly 70, travels the spray flow path of the center conduit 6, enters an aperture 125 in the bottom conduit 12, and exits sidelong through annular slits 128 in the bottom conduit 12, entering the radially-spaced holes 42 in discharge assembly 4 which form a spray exiting the lower aperture in housing 20 via the spray outlet 40 that encircles the aerator 70. It is noteworthy that the volume control assembly 70 is downstream of the spray/stream selector piston 160.

Opposing flanged collars 11, 14 are used to rigidly join upper conduit 90, center conduit 6, and lower conduit 12, by threading on to the threads present in center conduit 6. Both retaining collars 11, 14 are slip-fit over the respective upper conduit 90 and lower conduit 12 and tightening by threaded engagement. Fluid sealing between the upper conduit 90, center conduit 60 and lower conduit 12 is achieved by the use of rubber seals 3 and 4, respectively, as best seen in FIG. 5. The center conduit 6 is formed with three protruding ribs 67 that engage corresponding receiving slots internal to housing 20 to prevent rotation of selector subassembly 60 with respect to housing 20. Selector subassembly 60 is held in place in housing 20 (prevented from falling out of aperture 124) by the means of flanged cap 13 described above in regard to FIGS. 1-3.

Figure 9:
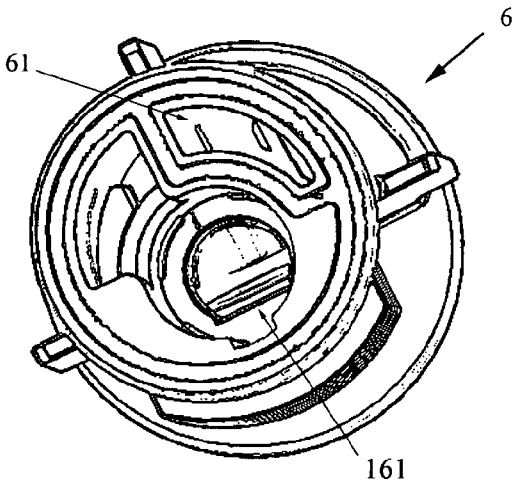
FIG. 9 is a top view of the center conduit 90.
Figure 10:
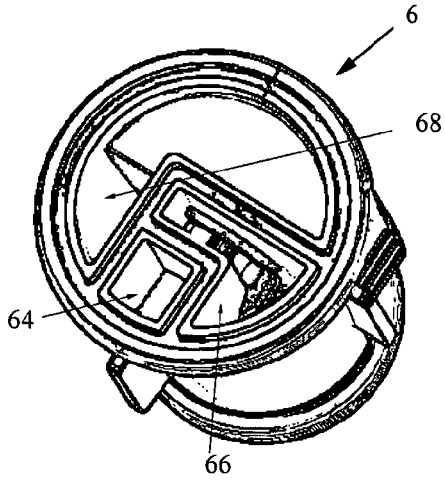
FIG. 10 is a bottom view of the center conduit 90.
Figure 11:
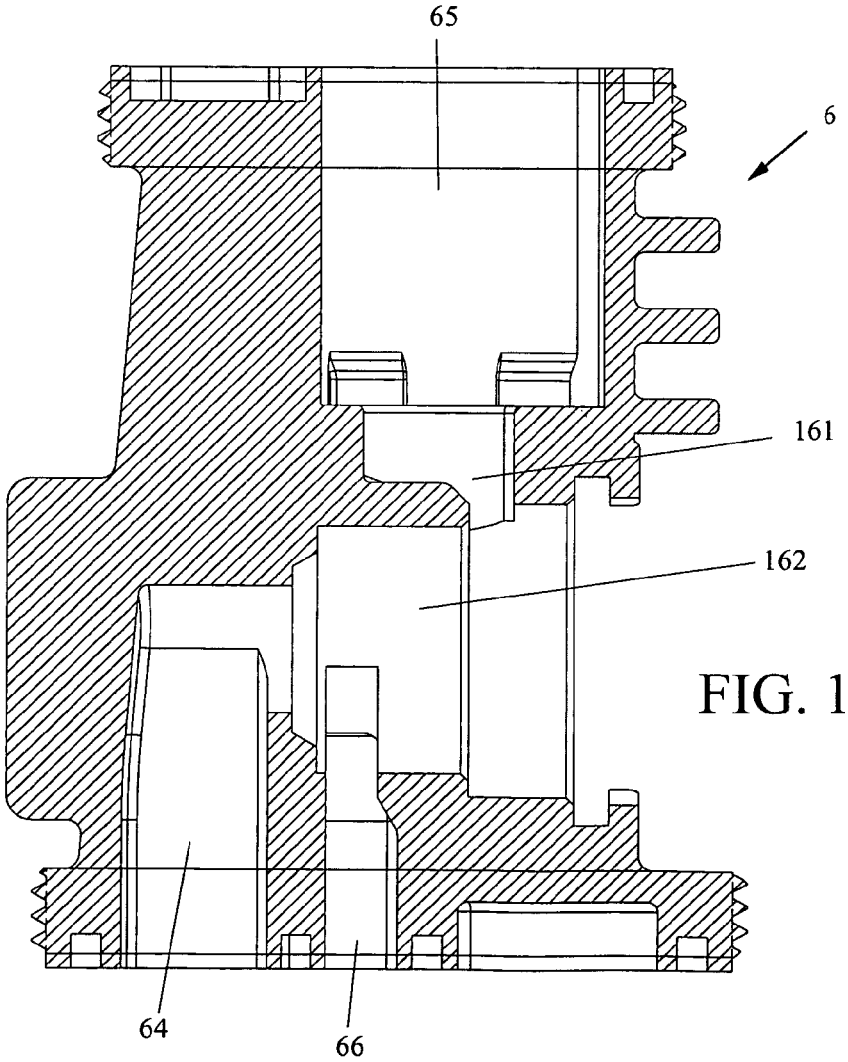
FIG. 11 is a side cross-section of the center conduit 90.

FIG. 9 is a top view of the center conduit 90, FIG. 10 is a bottom view, and FIG. 11 is a side cross-section of the center conduit 90. The center conduit 6 is a generally tubular member with upper externally-threaded barrel for attachment to the upper conduit 90. The center conduit defines three separate flow paths. First, the upper barrel leads into a passthrough port 61 that leads out through port 66 in the bottom (FIG. 10) of the center conduit 6, whereupon water is blocked by bottom conduit 12, and re-directed upward into diverter chamber 162. In addition, water flows into one of two lower apertures 64, 68. The stream/spray diverter assembly 60 shown in FIG. 3 includes a piston 160 that is inserted into a primary diverter chamber 162. One of the two ports 64, 68 is selected by the piston 160, and allowed to pass through the diverter chamber 162 continuing to the upper upper barrel of center conduit 6 and into upper conduit 90.

Figure 12:
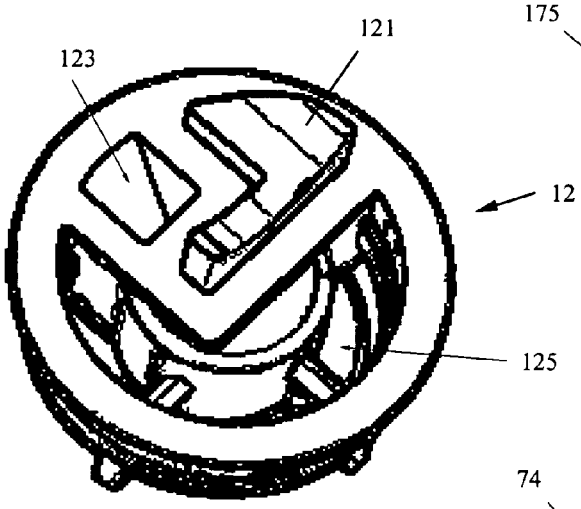
FIG. 12 is a top view of the bottom conduit 12.
Figure 13:
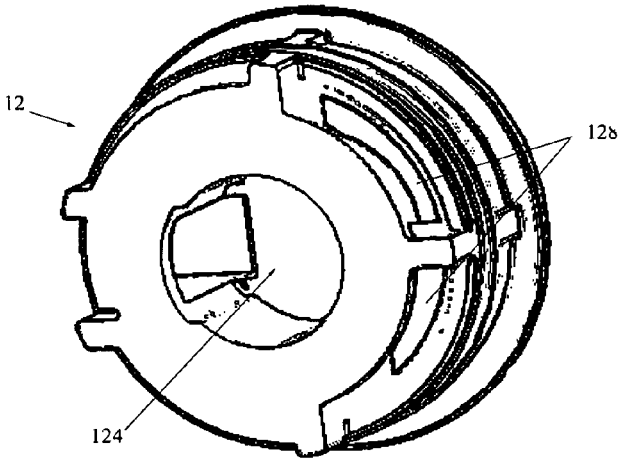
FIG. 13 is a bottom view of the bottom conduit 12.

FIG. 12 is a top view of the bottom conduit 12, and FIG. 13 is a bottom view of the bottom conduit 12. Water coming out through port 66 in the bottom (FIG. 10) of the center conduit 6 is blocked off and sealed by the bottom conduit 12, which employs a curved facing surface 121 to redirect the water back upwards, into the passage 66 in the bottom of the center conduit 6 (FIG. 10), and back into the primary diverter chamber 62. The curved facing surface 121 protrudes up into passage 66.

Operation of the above-described multi-mode spray head 2 will now be described by tracing the water pathway, from input through aerate mode, and from input through spray mode. As seen in FIGS. 1-3, initial water input comes from the existing faucet's pull-out extension hose, which extends from the faucet and screws into the upper conduit 90 that is in turn attached to the top housing 20 by means of flanged cap 13. With regard to FIGS. 4 and 5, the water continues into the selector sub-assembly 60 through the upper conduit 90, conduit 90 being rigidly mounted to center conduit 6 by retaining collar 11.

As seen in FIG. 3, the stream/spray diverter assembly 60 includes piston 160 inserted into the primary diverter chamber 162, and a finger-button 120 pivotally mounted in the outer housing 120 that bears against the piston 160 to allow the user to make the selection of either aerated output or spray output from the sprayhead 2.

If aerated output is selected, the water exits from aperture 64 as shown in FIG. 10. (In aerated mode, water goes forward from chamber 162, FIG. 11, straight to aperture 64). It then enters the aperture 123 of the bottom conduit 12 as seen in FIG. 12, and continues into chamber 124 (FIG. 13) and exits through the aerator 7 (FIG. 2).

On the other hand, if spray output is selected by depressing the finger-button 120 which bears against the piston 160 (FIG. 3), the piston 160 blocks off flow through the center conduit 6, and the water exits the top port 161 of the diverter chamber 162, as seen in FIG. 11, within which the volume control assembly 70 for the spray water resides (the volume control assembly is inside location 65 of conduit 6 of FIG. 11). The volume control assembly 70 is adjusted to select the desired volume of water by manual rotation of finger-knob 52, which turns collar 54, the teeth therein engaging the ring gear 100, which turns the volume control stem 7, which rotates the two flow control discs 72, 74 relative to each other thereby opening or closing the fluid coupling therewith. The selected volume of water exits the volume control stem 7 and volume control assembly 70, reaches the bottommost surface of the upper conduit 90, whereupon it is once again sealed off and re-directed downward, through the chamber 68 shown in FIG. 10. The water enters the aperture 125 of the bottom conduit 12 as seen in FIG. 12, and exits sidelong through the annular slits 128 of the bottom conduit 12 as seen in FIG. 13. From here, the water enters the radially-spaced holes 42 in discharge assembly 4 (FIG. 2), and exits as a spray through those spray holes 42 which exit outward through the bottom of the sprayer housing 20, via discharge assembly 4.

The layout of the water pathway described above achieves two goals. The first is to ensure that the volume control assembly 70 affects the sprayer water only, not the aerated stream. This requires that the volume control assembly 70 be placed downstream of the spray/stream selector piston 160. The second goal is to position the volume control knob 52 at the top of the sprayhead 2. This necessitates placing the entire volume control assembly 70 near the top of the sprayhead 2. The illustrated water pathway achieves the desired component locations.

Figure 14:
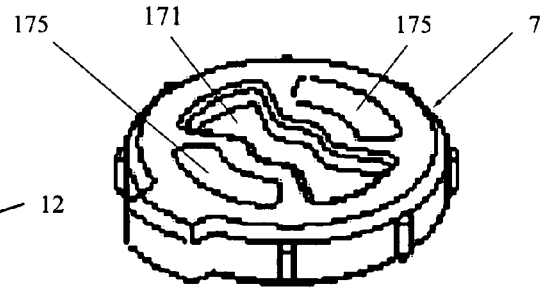
FIG. 14 is a perspective view of the bottom rotary disc 74.
Figure 15:
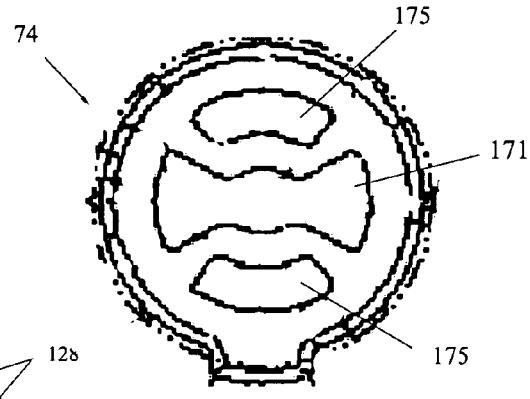
FIG. 15 is a top view of bottom disc 74.
Figure 16:
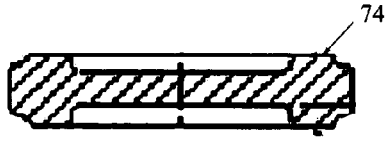
FIG. 16 is a side cross-section of the bottom rotary disc 74.

FIG. 14 is a perspective view of the bottom rotary disc 74, FIG. 15 is a top view of disc 74, and FIG. 16 is a side cross-section.

Figure 19:
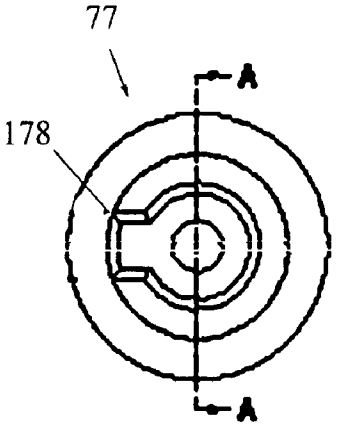
FIG. 19 is a top view of the volume control stem 77.
Figure 18:
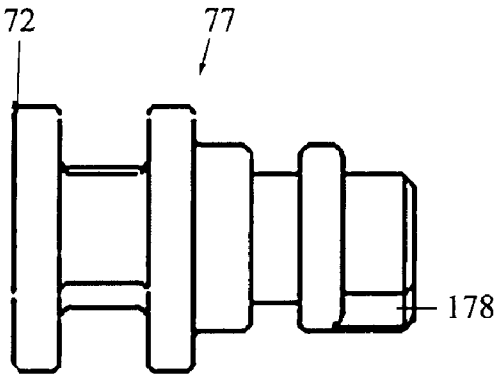
FIG. 18 is a side view of the volume control stem 77.
Figure 21:
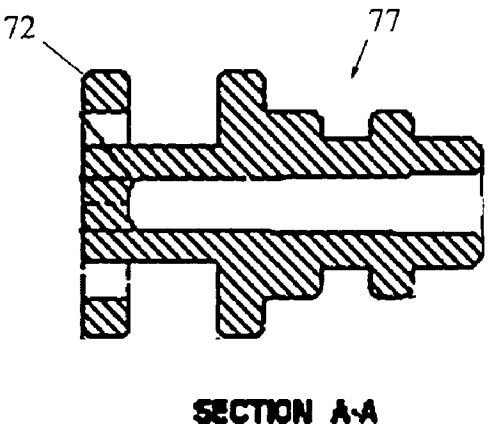
FIG. 21 is a side cross-section of the volume control stem 77 inclusive of the top rotary disc 72.
Figure 17:
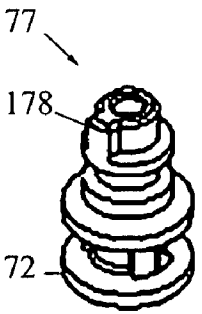
FIG. 17 is a perspective view of the volume control stem 77.
Figure 20:
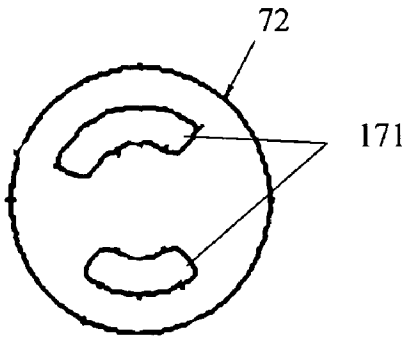
FIG. 20 is a bottom view of the top rotary disc 72 that is mounted distally at the end of control stem 77.

FIG. 17 is a perspective view of the volume control stem 77, FIG. 18 is a side view of the volume control stem 77, FIG. 19 is a top view, FIG. 20 is a bottom view of the top rotary disc 72 which is mounted distally at the end of control stem 77, and FIG. 21 is a side cross-section.

The holes 175 in the bottom rotary disc 74 are opened or closed by rotating the volume control stem 77, which in turn rotates the top rotary disc 72, thereby adjusting the alignment of holes 171 in the top rotary disc 72. The larger of the two holes 171 in the top rotary disc 72 forms a bleed path to ensure that the holes 175 in the bottom rotary disc 74 are never completely closed when the volume control knob 52 is turned to its lowest setting. Were the pathways through holes 171 in the top rotary disc 72 ever to completely close, the water from the spray mode would shut off entirely.

As seen in FIG. 21, the volume control stem 77 is an annular member shown here with a central channel and annular flange, and continuing to the integral top rotary disc 72 (Note that the channel and flange of control stem 77 are not active or critical features to the design, and are present only for manufacturing purposes). Water enters upwardly from beneath the bottom rotary disc 74. Disc 72 rotates, and its holes (FIG. 20) adjustably cover/uncover holes 175 in bottom rotary disc 74 (FIG. 15). To actuate or turn the volume control stem 77, the distal top end of the stem is formed as a keyway 178. The ring gear 100 (FIG. 5) is then attached to the keyway 178. The outward teeth of ring gear 100 engage the inward teeth of formed on annular collar 54, and collar 54 is turned by slide switch 52. The entire collar 54 and slide switch 52 assembly is preferably formed of Nylon™ or like material. Slide switch 52 protrudes from the backside of the sprayhead housing 20, and is meant to be turned by the user's index finger. Note that the illustrated collar 54 is defined by a horizontal relief cut beneath the switch 52, and an angular cutout above the teeth. These features help in installing the annular collar 54 into the outer housing. During assembly, the annular collar 54 is squeezed and deformed such that the angular cut in the back section becomes closed. This allows the part to be assembled through the top aperture 122 of the outer housing 20 without making additional cuts in the housing 20 and/or additional cover plates attached to housing. The upper conduit 90 protrudes up through the annular collar 54 and prevents it from deforming or collapsing, as it "rides" in the central annular space.

Figure 22:
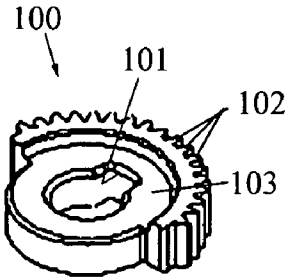
FIG. 22 is a rear perspective view of the ring gear 100.
Figure 23:
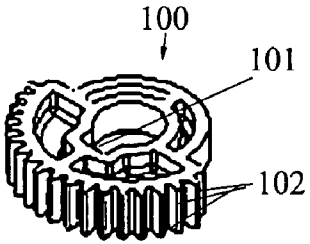
FIG. 23 is a front perspective view of the ring gear 100.
Figure 24:
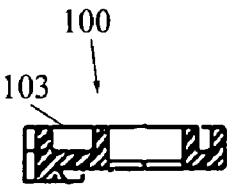
FIG. 24 is a side cross-section of the ring gear 100.

FIG. 22 is a rear perspective view of the ring gear 100, FIG. 23 is a front perspective view, and FIG. 24 is a side cross-section all showing a keyed central aperture 101 for attachment to the keyway 178 of volume control stem 77, and outwardly disposed teeth 102 for engaging the inward teeth of formed on annular collar 54. The teeth 102 run approximately 180 degrees around the ring gear 100. The ring gear 100 is also formed with a top recess 103 for seating against the lower platform 92 of the upper conduit 90.

Figure 25:
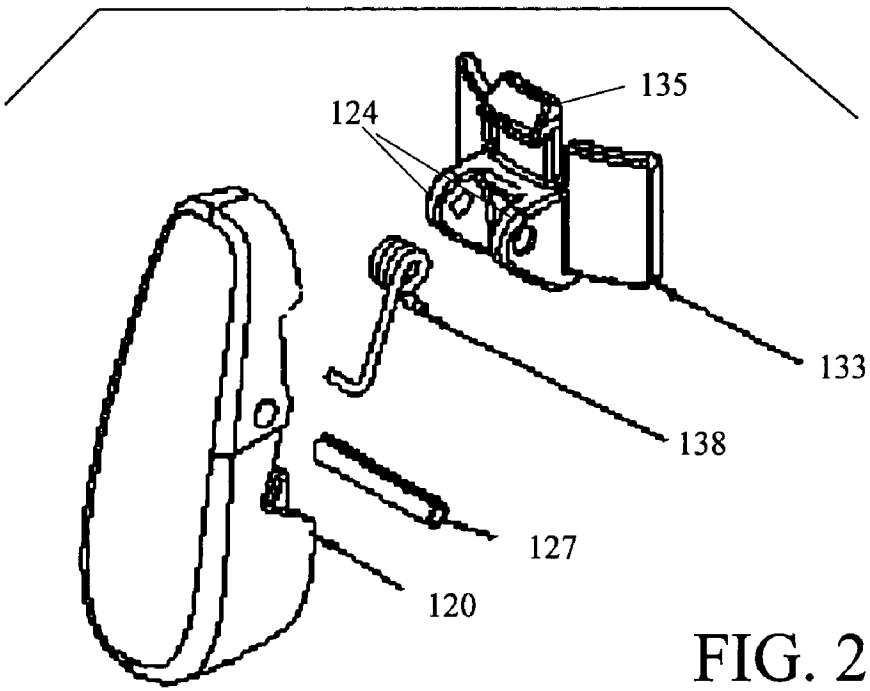
FIG. 25 is an exploded illustration of the detent finger-button 120 for allowing the user to select between spray mode and aerate mode.

FIG. 25 is an exploded illustration of the detent finger-button subassembly 120 for allowing the user to select between spray mode and aerate mode, as well as an attachment bracket 122 for securement to the housing 20. Attachment bracket 133 is a flanged mounting bracket with pivoting yoke 124 that is slidably secured inside the outer housing 20 by a clip-in detent catch 135 that engages the housing 20 (snaps over a rib present in the outer housing 20 when the finger-button subassembly 120 of FIG 25 is inserted into lower aperture 124 of housing 20 for assembly to housing 20). Detent finger-button 120 is pivotally secured to the yoke 124 by a transverse compression pin 127 inserted there through. A torsion spring 138 is inserted onto the pin 127 and is seated between the yoke 124 for biasing the detent finger-button 120 outward. The detent finger button 120 is exposed through the oblong slot in outer housing 20 and provides a convenient toggle-type button for selecting between aerate stream and spray output by actuating the diverter piston assembly 160 resident in the diverter chamber 162 of the central conduit 6. The detent finger-button 120 may be constructed of rigid plastic, and the torsion spring 138 serves the purpose of resetting the diverter piston assembly 160 to aerated output mode once the faucet water is turned off at its main valve. It is noteworthy that the position of the pin 127 with respect to the outer housing 20 is very near the outside edge of the outer housing 20. This allows matching curvature of the detent finger-button 120, and the oblong slot in the outer housing 20, and a reversal from the configuration normally found in sprayhead applications. Commonly, the pin 127 would be located well inside the housing, creating the necessity to make the receiving slot in the outer housing much larger than the finger-button. However, placement of the pin 127 near the surface of the housing 20, or well outside of it, by extension of the yoke 124 creates a circular sweep path for the finger-button 120 such that oversizing of the slot in the outer housing is not necessary. This configuration provides a much closer aesthetic match between the finger-button 120 and its corresponding receiving slot. It becomes much easier to change the aesthetic appearance of the sprayhead 2, simply by changing the outer housing 20, and, if desired, the contour of the finger-button 120. Note also that the finger-button 120 is formed with an inner catch 129 for engagement with the diverter piston assembly 160. This configuration also makes initial assembly easier because the detent finger-button selector subassembly 120 can be assembled outside the housing 20 (the detent finger button 120 and spring attached to the attachment bracket 133 to complete the sub-assembly), and then the detent finger-button selector subassembly 120 can be installed as a unit into the housing.

Figure 26:
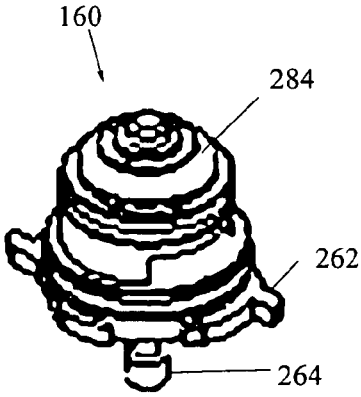
FIG. 26 is a perspective view of the diverter piston assembly 160 that is resident in the diverter chamber 162 of the central conduit 6.
Figure 27:
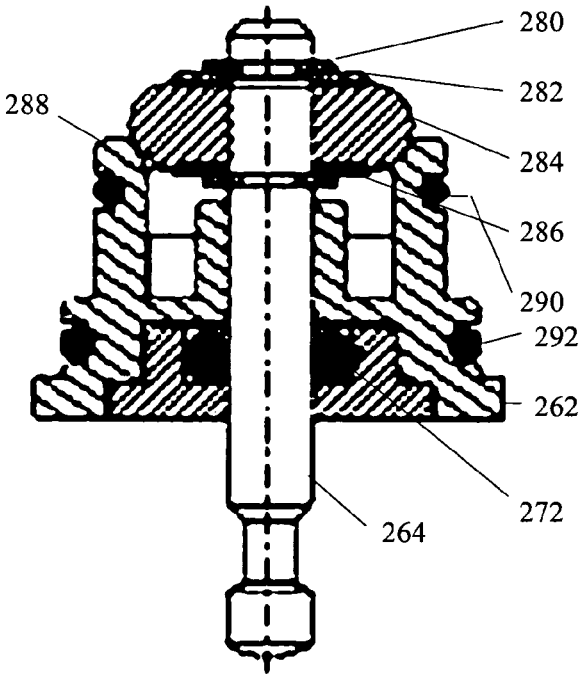
FIG. 27 is a side cross-section of the diverter piston assembly 160.
Figure 28:
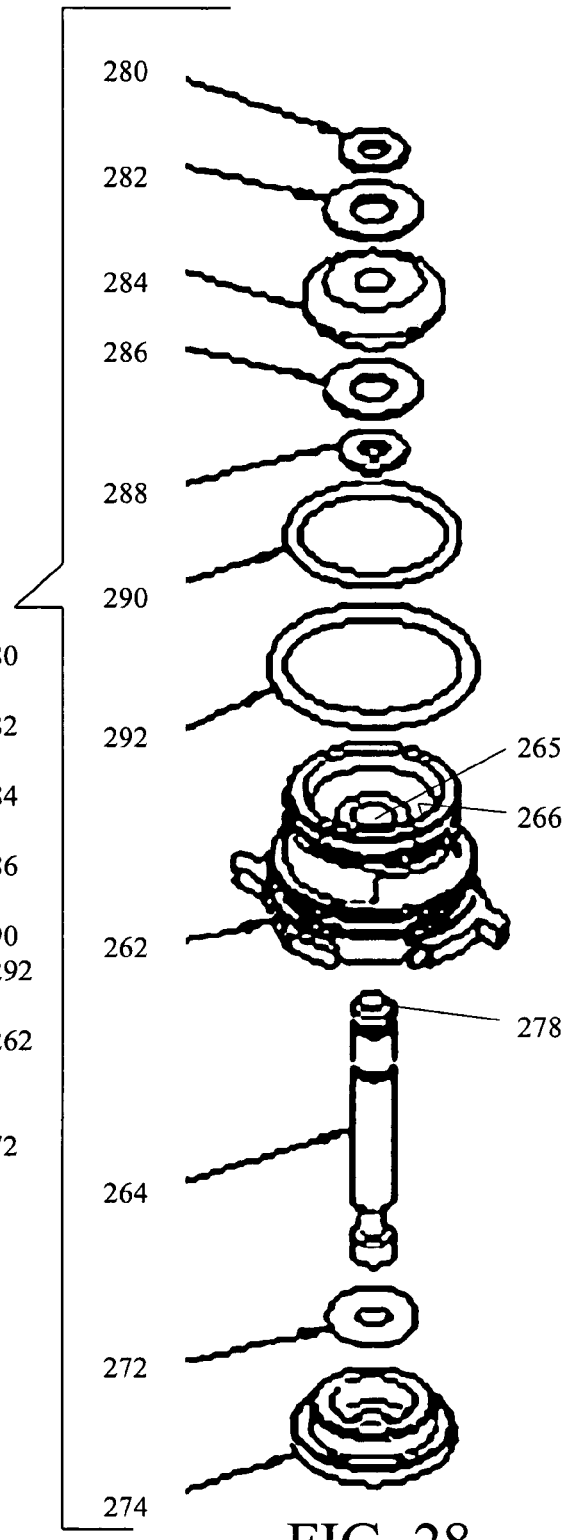
FIG. 28 is an exploded view of the diverter piston assembly 160.

FIG. 26 is a perspective view of the diverter piston assembly 160 that is resident in the diverter chamber 162 of the central conduit 6, FIG. 27 is a side cross-section view, and FIG. 28 is an exploded view of the diverter piston assembly 160. The diverter piston assembly 160 comprises an annular body 262 formed of plastic or like material with a central passage 265 leading into a top recess 266. A piston stem 270 is inserted through the central passage 265 of annular body 262, and an O-ring 272 and retaining cap 274 are secured about the piston stem 270. As seen in FIG. 27 the piston stem 264 protrudes past the retaining cap 274 and is formed with a distal head 276 that is captured within the inner catch 129 of the finger-button 120 for actuation thereby. The piston stem 270 protrudes upward through the annular body 262 to another distal head 278. A lock washer 280 is secured to the upper head 278 of piston stem 264, and this captures a sealing assemblage on the piston stem 264 that includes a retaining washer 282, rubber grommet 284, retaining washer 286, and lock washer 288 which is seated in an intermediate notch 289 in the piston stem 270. In addition, a pair of O-rings 290, 292 are seated around the periphery of the annular body 262 as shown to provide a sealing engagement with the diverter chamber 162 of the central conduit 6. In use, the annular body 262 is secured in the diverter chamber 162 by screw-threads or a keyed engagement, and the piston stem 264 remains free to slide there through effectively extracting/retracting the grommet 284 upon actuation of the detent finger-button 120 to stop or unstop the diverter chamber 162 entering sidelong into the aerated flow path of central conduit 6, thereby selectively interrupting the aerated flow path for diverting fluid flow to the spray flow path as described previously.

It is noteworthy that the torsion spring 138 described above with regard to FIG. 25 may be replaced by a standard compression spring loaded onto piston the protruding piston stem 264 and biased within the diverter chamber 162 in center conduit 6.

The above-described sprayhead 2 achieves uniform delivery of water, in selectable spray and aerate modes, and allows volume control for reducing/increasing the volume of water when the sprayhead is in spray mode, with no affect on the volume of water when in aerate mode.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. A sprayhead for connection to a faucet for expelling water, comprising:

a sprayhead housing a first control comprising a detent finger-button in the sprayhead housing for allowing a user to manually select between a spray mode for expelling a spray of water, and an aerate mode for expelling an aerated stream of water; and second control in the sprayhead housing for allowing said user to adjust a flow volume of water expelled from said sprayhead.

2. A sprayhead for connection to a faucet for expelling water, comprising:

a sprayhead housing a first control in the sprayhead housing for allowing a user to manually select between a spray mode for expelling a spray of water, and an aerate mode for expelling an aerated stream of water; and a second control in the sprayhead housing comprising a slide switch for allowing said user to adjust a flow volume of water expelled from said sprayhead.

3. The sprayhead for expelling water according to claim 2, wherein said second control adjusts the volume of water expelled from said spray head when in spray mode.

4. The sprayhead for expelling water according to claim 1, wherein said detent finger-button remains in a normally unbiased first position for said aerate mode, and is depressed to a second biased position for selection of spray mode.

5. The sprayhead for expelling water according to claim 2, wherein said slide switch is adjusted within a range of positions and, when released, maintains a position.

6. The sprayhead for expelling water according to claim 2, wherein said second control comprises a ring gear.

7. The sprayhead for expelling water according to claim 6, wherein said ring gear comprises an annular collar with gear teeth, said slide switch being formed integral to said collar.

8. A sprayhead for connection to a faucet for expelling water, comprising:

a sprayhead housing a first control in the sprayhead housing for allowing a user to manually select between a spray mode for expelling a spray of water, and an aerate mode for expelling an aerated stream of water;

a second control in the sprayhead housing for allowing said user to adjust a flow volume of water expelled from said sprayhead;

a plurality of conduits defining a water input path in fluid communication with a spray flow path and an aerated flow path; and a diverter chamber interrupting said aerated flow path, said first control including a movable piston loaded into said diverter chamber for selectively interrupting the aerated flow path to divert water into the spray flow path.

9. A sprayhead for connection to a faucet for expelling water, comprising:

a sprayhead housing a first control comprising a selector sub-assembly in the sprayhead housing for allowing a user to manually select between a spray mode for expelling a spray of water, and an aerate mode for expelling an aerated stream of water;

a second control in the sprayhead housing for allowing said user to adjust a flow volume of water expelled from said sprayhead; and a plurality of conduits defining a water input path, a spray flow path in fluid communication between said input path and a spray outlet, an aerated flow path in fluid communication between said input path and an aerated outlet, and a diverter chamber interrupting said aerated flow path, said selector sub-assembly including a movable piston loaded into said diverter chamber for selectively interrupting the aerated flow path to divert water into the spray flow path.

10. The sprayhead for expelling water according to claim 9, wherein said movable piston is moved within said diverter chamber by a detent finger-button for selection between said spray mode and said aerate mode.

11. A sprayhead for connection to a faucet for expelling water from said faucet, comprising:

an outer sprayhead housing a first control comprising a detent finger-button in the sprayhead housing for selecting one of a spray mode and an aerate mode: and said aerate mode;

a second control in the sprayhead housing for adjusting a flow volume;

a conduit assembly having a first flow path for said spray mode and a second flow path for said aerate mode;

a mode selector sub-assembly enclosed within said housing in cooperation with said first control for selecting one of said first flow path and said second flow path;

a flow control assembly enclosed within said housing in cooperation with said second control for adjusting water flow volume in said second flow path.

12. A sprayhead for connection to a faucet for expelling water from said faucet, comprising:

an outer sprayhead housing a first control in the sprayhead housing for selecting one of a spray mode and an aerate mode;

a second control comprising a slide switch in the sprayhead housing for adjusting said flow volume of water;

a conduit assembly having a first flow path for said spray mode and a second flow path for said aerate mode;

a mode selector sub-assembly enclosed within said housing in cooperation with said first control for selecting one of said first flow path and said second flow path; a flow control assembly enclosed within said housing in cooperation with said second control for adjusting water flow volume in said second flow path.

13. A sprayhead for connection to a faucet for expelling water from said faucet, comprising:

an outer sprayhead housing a first control in the sprayhead housing for selecting one of a spray mode and an aerate mode;

a second control in the sprayhead housing for adjusting the flow volume of water in spray mode, but having no affect on flow volume in aerate mode; a conduit assembly having a first flow path for said spray mode and a second flow path for said aerate mode;

a mode selector sub-assembly enclosed within said housing in cooperation with said first control for selecting one of said first flow path and said second flow path;

a flow control assembly enclosed within said housing in cooperation with said second control for adjusting water flow volume in said second flow path.

14. The sprayhead for expelling water according to claim 11, wherein said detent finger-button remains in a normally unbiased first position for said aerate mode, and is depressed to a second biased position for selection of spray mode.

15. The sprayhead for expelling water according to claim 12, wherein said slide switch is adjusted within a range of positions and, when released, maintains a position.

16. A method of controlling a flow of water from a faucet through a sprayhead coupled to said faucet, comprising the steps of:

pressing a first control comprising a detent fingerbutton in the sprayhead and exteriorly accessible there from to select between a spray mode for expelling a spray of water, and an aerate mode for expelling an aerated stream of water; and using a second control in the sprayhead and exteriorly accessible there from to adjust a flow volume of water.

17. A method of controlling a flow of water from a faucet through a sprayhead coupled to said faucet, comprising the steps of:

using a first control in the sprayhead and exteriorly accessible there from to select between a spray mode for expelling a spray of water, and an aerate mode for expelling an aerated stream of water; and sliding a second control comprising a slide switch in the sprayhead and exteriorly accessible there from to adjust a flow volume of water.

* * * * *